US005715955A

United States Patent [19]

Hannecke

[11] Patent Number: 5,715,955

[45] Date of Patent: Feb. 10, 1998

[54] MERCHANDISE PRESENTATION SYSTEM OF MODULAR DESIGN

[76] Inventor: Wolf-Dietrich Hannecke, Rischenau Weg 6, 37254 Northeim, Germany

[21] Appl. No.: 572,138

[22] Filed: Dec. 14, 1995

[51] Int. Cl.[6] ..... A47F 5/00

[52] U.S. Cl. ..... 211/163; 211/205; 211/131

[58] Field of Search ..... 211/126, 131, 211/129, 56, 58, 53, 163, 196, 205

[56] References Cited

U.S. PATENT DOCUMENTS

| | | | |
|---|---|---|---|
| D. 275,920 | 10/1984 | Hannecke . | |
| D. 276,011 | 10/1984 | Hannecke . | |
| 1,963,544 | 6/1934 | Burt | 211/53 |
| 3,833,128 | 9/1974 | Summer | 211/131 |
| 4,336,759 | 6/1982 | Hannecke . | |
| 4,498,401 | 2/1985 | Hannecke . | |
| 4,512,262 | 4/1985 | Hannecke . | |
| 4,736,856 | 4/1988 | Alneg et al. | 211/131 |
| 4,889,246 | 12/1989 | Lee | 211/205 X |
| 4,976,359 | 12/1990 | Hardy | 211/58 |
| 5,127,528 | 7/1992 | Cone | 211/163 X |

*Primary Examiner*—Robert W. Gibson, Jr.
*Attorney, Agent, or Firm*—Kenyon & Kenyon

[57] ABSTRACT

This invention relates to a merchandise presentation system of modular design, consisting substantially of a vertically upright central support pole (1) which has regularly arranged openings (2), configured for example as undercut lengthwise grooves, as well as of merchandise carriers (3) that can be mounted on the support pole (1), the merchandise carriers (3) having mounting means (4), corresponding to the openings (2), by means of which they can be mounted on the support pole (1) at the positions defined by the openings (2), characterized in that the openings (2) and the mounting means (4) corresponding thereto are arranged and configured in such a way that the individual merchandise carriers (3) can be mounted with the mounting means (4) laterally on the support pole (1) into the openings (2), the individual merchandise carriers (3), which otherwise are of any dimensions and shape, not being configured as tray-like merchandise carrier enclosing the support pole (1) in their center.

17 Claims, 4 Drawing Sheets

MERCHANDISE PRESENTATION SYSTEM OF MODULAR DESIGN

FIELD OF INVENTION

The present invention relates to a merchandise presentation system of modular design which comprises a vertically upright central support pole which has regularly arranged openings configured, for example, as undercut lengthwise grooves, and a plurality of merchandise carriers that can be mounted on the support pole, the merchandise carriers having mounting means, corresponding to the openings, by means of which they can be mounted on the support pole at the positions defined by the openings.

BACKGROUND OF INVENTION

Visually effective exhibition of merchandise intended for sale or as free information material, takes place in merchandise presentation systems, which are often also referred to as displays. Conventional displays include shelves, counters, cabinets, racks and the like. Such displays may be configured as rotating columns which have, as compared to other types of merchandise presentation systems, the advantages of being flexible and space-saving to use. Display columns of this kind are used principally to display flat objects, e.g. books, newspapers, postcards, boxes, audio media, videocassettes, digital storage media, or the like, arranged in merchandise carriers configured as shelves or trays which receive the merchandise. Such tray-like merchandise carriers have in their center an orifice through which and vertically upright central support pole passes. The number and vertical spacing of the tray-like merchandise carriers stacked one above the other on a support pole should be based on the height of the merchandise being used. The tray-like merchandise carrier themselves maybe divided into a plurality of receiving compartments, the number, arrangement, and configuration of which is adapted to the quantity and format packaging of the merchandise being used.

Since merchandise presentation systems frequently are exposed to high stresses, especially their movable parts, their manufacture can be relatively complex. Moreover, because business is increasingly demanding distinctive merchandise presentation systems that differ from one another in terms of shape and color and whose external appearance is matched to the particular merchandise to be displayed, the result is a problem with short-run production which is very expensive. Also evident is a tendency toward shorter and shorter product cycles, the result of which in turn is that the merchandise presentation systems must be adapted to new generations of merchandise at shorter and shorter intervals. To address the aforesaid difficulties, merchandise presentation systems having a modular adjustable designs have been available for some time. For example, U.S. Pat. No. 4,336,759 describes a display column that saves on both costs and individual parts, and in order to allow subsequent adaptation of an existing display to a different line of merchandise, the central support pole has a plurality of openings aligned with one another in the lengthwise direction. The openings are used for releasable fastening of the tray-like merchandise carriers onto the support pole in almost any desired vertical position. For this purpose, the tray-like merchandise carriers have mounting means which are configured as projections which correspond to the openings and are arranged on the periphery of the orifice located in the center of the tray-like merchandise carriers. This makes it possible both to exchange different tray-like merchandise carriers, and to easily adjust their height on the display column. The flexibility of merchandise presentation systems configured in this manner encounters limitations, however, when merchandise in different packaging sizes is to be arranged on the same plane, i.e., tray-like merchandise carrier, or when there is a desire to replace such one-piece carriers. A further disadvantage of conventional merchandise presentation systems is that when an individual tray-like merchandise carrier is to be replaced is not the one arranged at the very top, those carriers not involved but located above the one to be replaced must first be emptied and removed from the support pole. If the display column in question includes a cover structure then replacing the top tray-like merchandise carrier may also be laborious and time-consuming. If the display columns stand on the floor and have a height dimension of at least 180 cm, replacing the bulky tray-like merchandise carrier, which even when empty are not light, may present additional difficulties and may be associated with the risk that all the tray-like merchandise carriers must be fitted over the support pole, requiring one to work over one's head or with the aid of a ladder.

It is therefore the object of this invention to provide a merchandise presentation system of a generic type which provides simpler and more flexible replacement of the merchandise carriers and to allow advantageous arrangements of the merchandise carriers thereon so as to provide more efficient use of space as well as visually attractive configurations.

SUMMARY OF THE INVENTION

The present invention provides a merchandise presentation system, comprising a support pole and a plurality of merchandise carriers at least one mounting means associated with each merchandise carrier for establishing cooperative engagement between the support pole and each merchandise carrier and the mounting means being configured so that the merchandise carriers can be individually mounted on the support pole from a lateral direction substantially perpendicular to the longitudinal axis of the support pole.

BRIEF DESCRIPTION OF THE DRAWINGS

The invention will be further explained below with reference to a particularly preferred exemplary embodiment depicted in the drawing, the individual figures of which show.

DETAILED DESCRIPTION OF THE INVENTION

Figure 1:
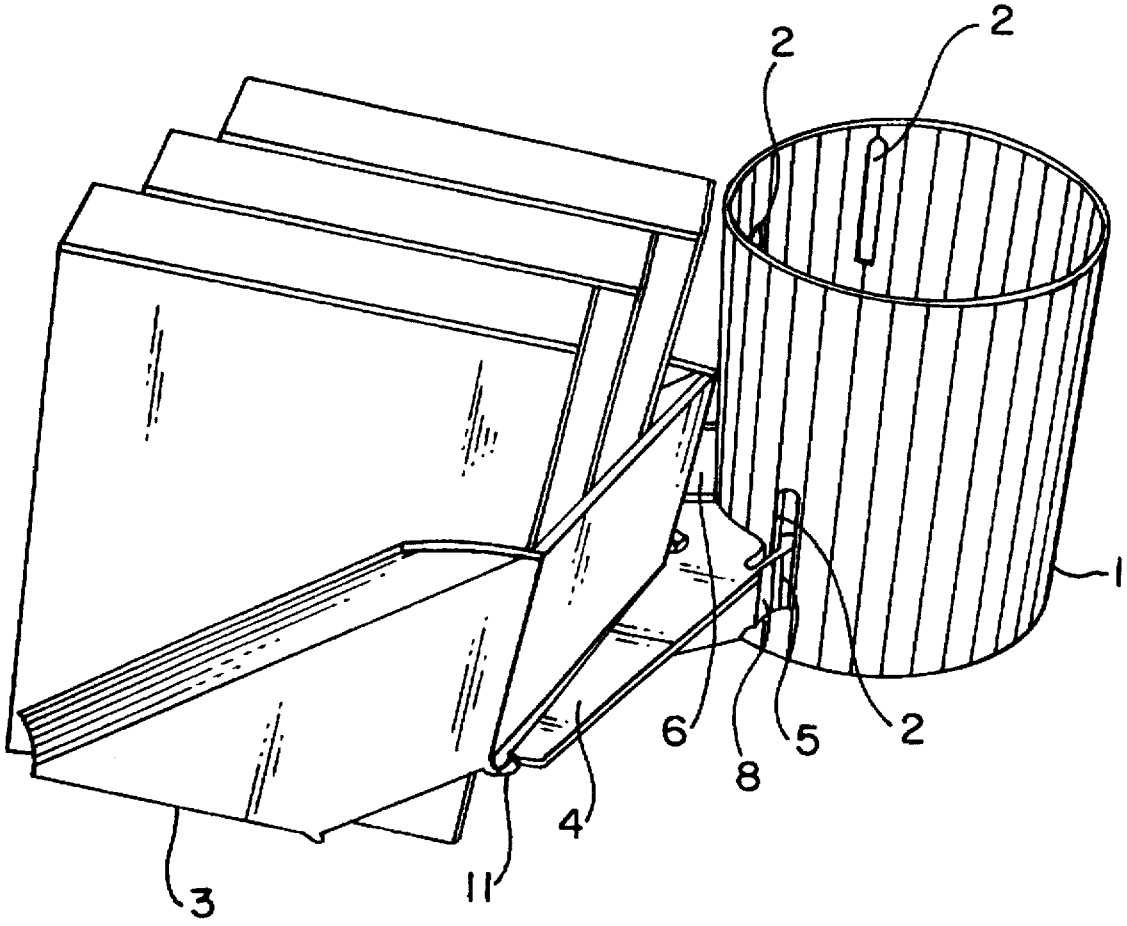
FIG. 1: a partial perspective side view of a merchandise presentation system according to the invention.

According to the invention, the above and other objects are achieved by the fact that the openings and the mounting means corresponding thereto are arranged and configured in such a way that the individual merchandise carriers can be mounted with the mounting means laterally on the support pole into the openings, the individual merchandise carriers, which otherwise are of any dimensions and shape, not being configured as tray-like merchandise carrier enclosing the support pole in their center. According to the invention and in contrast to the known display columns, the merchandise carriers no longer extend angularly around the support pole, and therefore also have no central orifice for positioning and mounting on the support pole. During installation and replacement of merchandise carriers, the laborious process of fitting over the support pole is therefore eliminated. Instead, each individual merchandise carrier can be mounted laterally on the support pole, and if necessary replaced with another, independently and with no impairment to merchandise carriers already fastened on the support pole. Because an individual merchandise carrier no longer extends around the support pole in the form of an entire shelf or plate, but instead now occupies pie-slice portions with reference to the overall body of the merchandise presentation system, the result, especially when only one receiving compartment is provided for each merchandise carrier, is far greater flexibility in replacement and also in terms of the specific arrangement of the merchandise carriers on the support pole. The existing space can be better utilized by the fact that the individual receiving compartments can now be arranged not next to one another on a common circular plane, but offset from one another depending on their vertical space requirement. The modular design system, known in the art, is further improved by achieving greater replacement flexibility together with reduced transport and storage volumes, by making the components smaller.

All merchandise presentation systems according to the invention can advantageously be configured as rotating columns if the support pole is mounted in axially rotatable fashion on a stand or even on a movable frame. The axial rotation capability of the support pole can, for example, be attained by installation on a ball bearing or roller bearing or other means well know in the art.

According to a preferred embodiment of the invention, fastening of the merchandise carriers to the support pole occurs in such a way that the openings on the support pole are undercut, and the mounting means have profiled extensions that can be inserted into the openings. Because the profiled extensions undercut to cooperate with the undercuts in the openings, so that they can be inserted into a unoccupied opening in the support pole, displaced downward, and in this manner fastened positively to the support pole, but can also be detached and removed in the reverse manner. The mounting means can, for example, be configured as downward-pointing hooks. In this embodiment better attachment is achieved if the undercuts are provided on the vertical flanks of the profiled extensions. The openings corresponding thereto have a larger cross-section into which the profiled extensions are inserted, as well as a smaller cross-section located beneath it into which the profiled extensions, once inserted, are slid and thereby fastened.

According to another embodiment, fastening of the merchandise carriers to the support pole can be achieved in an analogous manner. The difference resides in the fact that the openings and mounting means are configured so that in each case two profiled extensions can be fastened into a single opening. Positive fastening to the support pole is achieved by cooperation of each profiled extension with the opening they are inserted into. The two profiled extensions behave as if they were only one. In this embodiment, both profiled extensions can, for example, be configured as downward-pointing hooks, or one profiled extension can have an undercut having an undercut on its left-hand vertical flank and the other profiled extension on its right-hand vertical flank. The embodiment just described has, for example, the advantage that while maintaining an equal number of openings on the support pole, the number of possible mounting positions for the merchandise supports is doubled as compared with the variant described before. Suitable dummy profile extensions may be provided for cases in which, because of the desired arrangement of the merchandise carriers, only one profiled extension is mounted in an opening provided for the fastening of two profiled extensions.

The load capacity of the merchandise carriers fastened to the support pole can be advantageously increased if the mounting means are each equipped with a pair of profiled extensions arranged substantially horizontally, the profiled extensions each being undercut on the side facing the other profiled extension. The two profiled extensions are arranged on the mounting means in such a way, and spaced vertically apart from each other at such an angle, that the respective left-hand profiled section can be fastened in an opening with the right-hand profiled extension of the mounting means arranged adjacently to the left on the support pole. The same applies analogously and inversely for the respective right-hand profiled extension.

According to a further embodiment, the profiled extensions may be arranged in pairs on a particular mounting means and spaced apart vertically from one another. In this embodiment, the profiled extensions on an individual merchandise carrier engage in two separate openings spaced vertically apart from one another, so that additional stability is imparted to the merchandise carrier when fastened to the support pole.

Whenever two profiled extensions that are undercut on their vertical flanks are arranged so that they can be fastened into a single opening, the openings do not need to be divided into a larger and a smaller section. Instead the openings can be configured as substantially vertically arranged slots or grooves, such that the height of the profiled extensions must be no more than half the length of the openings. Fastening must then occur in such a way that the two profiled extensions are inserted, offset in height with respect to each other, into an opening and mounted by sliding downward the profiled extension inserted highest up on the support pole. If, with the embodiment of the invention just described, two profiled extensions are arranged on one mounting means, it is then necessary for the profiled extensions to be made resilient in the horizontal direction, so as thereby to allow insertion into the openings.

A further advantageous embodiment is characterized by the fact that the merchandise carriers and mounting means each have, at the side facing an adjacently arranged merchandise carrier, a projection and a cooperating recess respectively, the projection of the one merchandise carrier engaging, when fastened to the support pole, positively into the recess of an adjacently arranged merchandise carrier. Preferably the projection and recess are each laterally undercut so as to fit one another, and in this manner form a dovetail insertion profile. The resulting additional attachment of the merchandise carriers and their mounting means to one another results improved stability of the entire assembled display, which becomes noticeable in a positive sense above all when the merchandise carriers are to be filled with heavy objects, such as books or magazines.

According to a particularly preferred embodiment of the invention, the mounting means are configured as independent coupling elements that are removable from the respective merchandise carrier. This feature makes it possible, when necessary, to replace the actual merchandise carrier independently of the mounting means. In addition, however, by replacing existing coupling elements with corresponding separately manufactured coupling elements it is possible to accommodate either new configurations on the support pole, or a desire to fasten the existing merchandise carrier modules to entirely different support systems. For example, flexible utilization of the same merchandise carrier modules on all the support systems present in a retail facility is possible, the spectrum of potential support systems ranging from movable or stationary free-standing sales stands or rotating columns, through stationary wall elements or flexible modular furniture, to simple wall rails and so on.

It will be appreciated that the mounting means and opening arrangement could be reversed, i.e., the mounting means projecting from the support pole and openings in the carriers, in at lease some embodiments. For detachable fastening of the mounting means to the respective merchandise carriers, it is, for example, possible to provide a slide-in profile which comprises a receiving part and a slide-in part that can be slid into the latter. If applicable, the slide-in profile is equipped with a retaining means, configured, for example, in the manner of a catch or a snap attachment, which prevents inadvertent release of the mounting means from the merchandise carrier. An improvement in torsional rigidity and a general improvement in the stability of the attachment between mounting means and merchandise carrier can be achieved by, for example, suitably arranged support rails.

If the merchandise carriers, corresponding in terms of their shape and dimensions to the conditions set forth above, are each to have only a single receiving compartment, and a decision is made for this reason in favor of a substantially quadrangular base outline, it is then particularly advantageous if the base outline is configured as a substantially non-rectangular parallelogram. The advantage lies in the fact that goods arranged in a merchandise carrier configured in this way, for example books, boxes, or cassettes, are visible in a slightly fanned-out arrangement, removal and replacement of individual goods is simplified, and an annular arrangement of multiple merchandise carriers around the support pole becomes possible, considerably reducing unused dead space.

With merchandise carriers of quadrangular configuration in particular, it is advantageous if the latter, when fastened to the support pole, are tilted slightly backward and/or to the side by a corresponding configuration of the mounting means. The tilt to the rear prevents the merchandise from accidentally falling out of the merchandise carrier, which becomes advantageous especially for movable or portable display columns. With a lateral tilt, the merchandise carriers can be packed more easily and at the same time more tightly.

Materials that typically used in the furniture sector are suitable for producing the merchandise presentation systems according to the invention. It is advantageous if the merchandise carriers and mounting means, in particular, are produced at least partly from weight-saving plastic. Injection-molded plastic parts, which can be produced economically in large volumes, have the additional advantage that they are especially suitable for the insertion and slide-in profile attachments according to the invention. Moreover, the color and transparency of the molded parts or modules can be varied without great expense.

The support pole preferably comprises a substantially hollow tube in which the openings are configured as perforations arranged regularly in a grid-like pattern. If the support pole comprises a hollow plastic tube, the openings can easily be milled into its surface. Alternatively, mounting means could be formed in or mounted on the support pole as noted above.

As already mentioned, the invention also provides novel and visually attractive arrangements of merchandise carriers on the support pole. For example, if the individual merchandise carriers are mounted on the support pole next to one another and in a continuous series, i.e., adjacent one-another and offset in height from one another in such a way that the support pole, once completely occupied by merchandise carriers, acquires a helical configuration, the result as compared with known systems is a striking and characteristic, ornamental external appearance which thus also promotes sales. In addition, however, the helical structure just described has the advantage that a customer standing in front of a rotating column configured in this manner, and looking for a specific item, can begin at the highest or lowest merchandise carrier and browse through the contents of each merchandise carrier while continuously turning the display column, without having to concentrate on which point he or she must look at on the next shelf tray.

Figure 2:
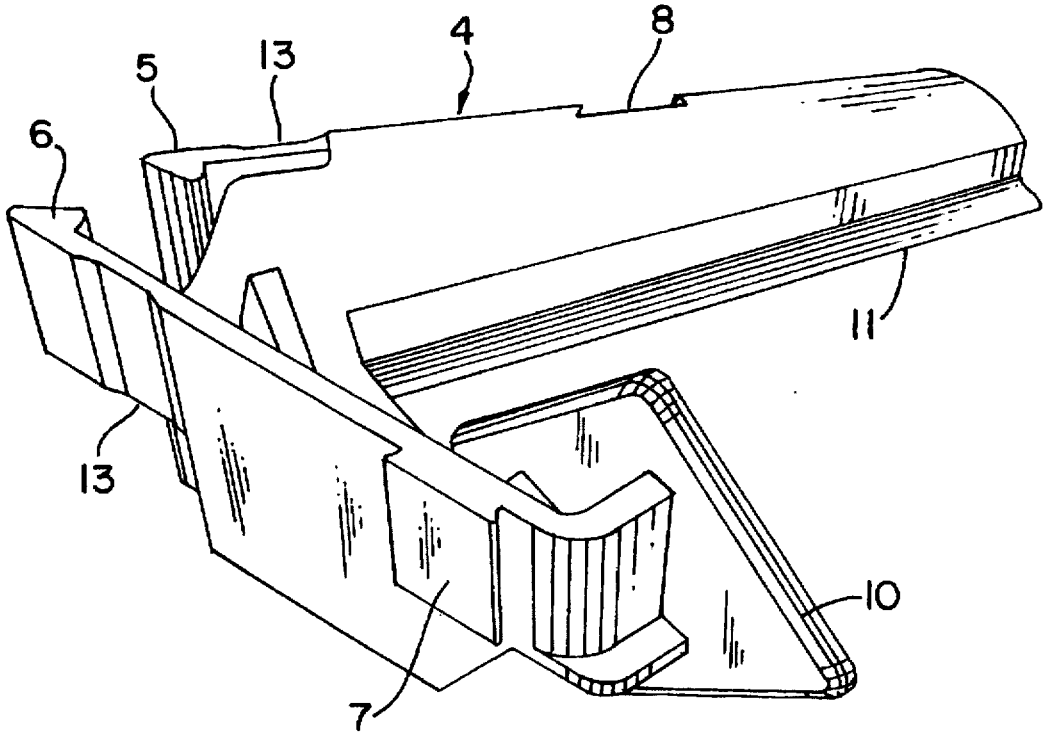
FIG. 2: a perspective view of a mounting means according to the invention.
Figure 3:
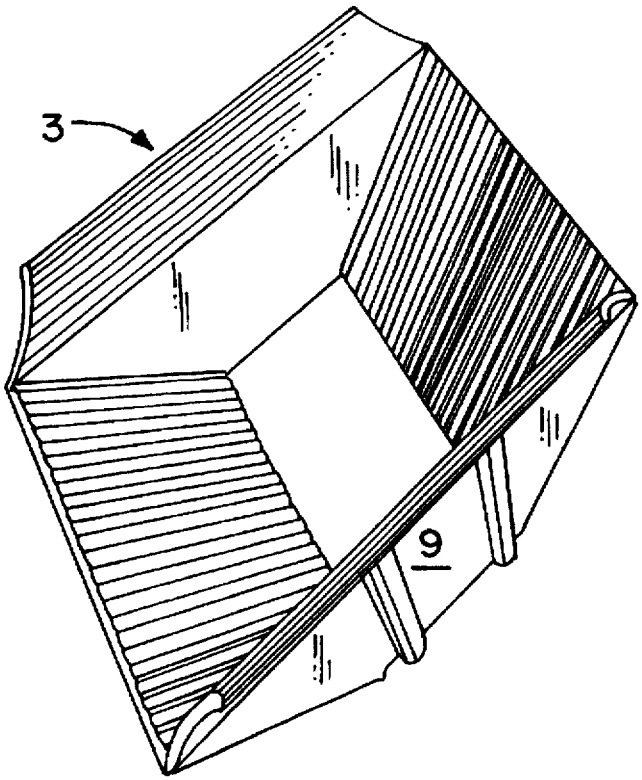
FIG. 3: a perspective view of a merchandise carrier according to the invention.

More particularly, FIG. 1 illustrates how a merchandise carrier 3, loaded with books and placed on a mounting means 4, is engaged with a support pole 1, reproduced only partially and configured as a hollow plastic tube. Mounting means 4 and merchandise carrier 3 are shown individually in FIGS. 2 and 3, respectively. These parts may be made of plastic and manufactured using an injection molding process. For mounting on support pole 1, mounting means 4 has two profiled extensions 5 and 6, configured differently and spaced apart from one another both horizontally and vertically. The two profiled extensions 5 and 6 are angled slightly apart from one another corresponding to the curve of support pole 1. As shown in FIG. 1, the undercut openings 2 are configured as vertically arranged slots milled into support pole 1, which are exactly twice as long as the length or height dimension of inserted profiled extensions 5 or 6. FIG. 2 shows that profiled extensions 5 and 6 are each undercut at their mutually facing vertical flanks, and are each tapered at their free end. Profiled extensions 5 and 6 of each mounting means 4 can thus be inserted into two openings 2, and snapped in by exerting gentle pressure. Material openings or weakened sections 13 marked in FIG. 2 increase the required horizontal flexibility of profiled extensions 5 and 6.

A total of four openings 2, arranged in ascending sequence, are located in the portion of the exemplary embodiment depicted in FIG. 1. Accordingly, two more of each of the mounting means 4 and merchandise carriers 3, reproduced individually in FIGS. 2 and 3, can be fastened in succession in this portion of support pole 1. If the portion of support pole 1 shown in FIG. 1 is occupied, successively in ascending sequence, by further mounting means 4 and merchandise carriers 3, the respective right-hand opening 2 is already partly filled by profiled extension 6 of mounting means 4 arranged on the lower right. The previously installed adjacent mounting means 4 must therefore, as shown in FIG. 1, be slid into the two lower halves of the already occupied openings 2 before a further mounting means 4 can be snapped into the two upper halves of its two openings 2. Only after it is snapped in is the space necessary for downward displacement of the adjacent, snapped-in mounting means 2 possible. The downward displacement brings profiled extensions 6 and 5 of the two adjacent mounting means 4, which are engaged into a single opening 2, to the same height and thus fastens them to support pole 1. In addition, undercut projection 7 (shown in FIG. 2) of mounting means 4 that was first inserted slides, forming a dovetail profile, into recess 8 (also undercut) of the mounting means that was inserted last. Mounting means 4 are thus each engaged with one another, and also below one another in continuous sequence.

In the present exemplary embodiment, a push-in profile (not visible in FIG. 1) is provided for detachable connection between mounting means 4 and merchandise carrier 3. The push-in profile, configured with a large surface area, contains a receiving part 9 arranged on the merchandise carrier and a matching slide-in part 10 on mounting means 4. The two individual components are each visible in FIG. 1 and FIG. 2. To prevent slide-in part 10 from accidentally sliding out of receiving part 9, a retaining means, not shown for reasons of clarity and configured in the manner of a catch or snap attachment, can be provided. Mounting means 4 moreover has a support rail 11 which imparts additional stability to merchandise carrier 4 fastened to it.

Figure 4:
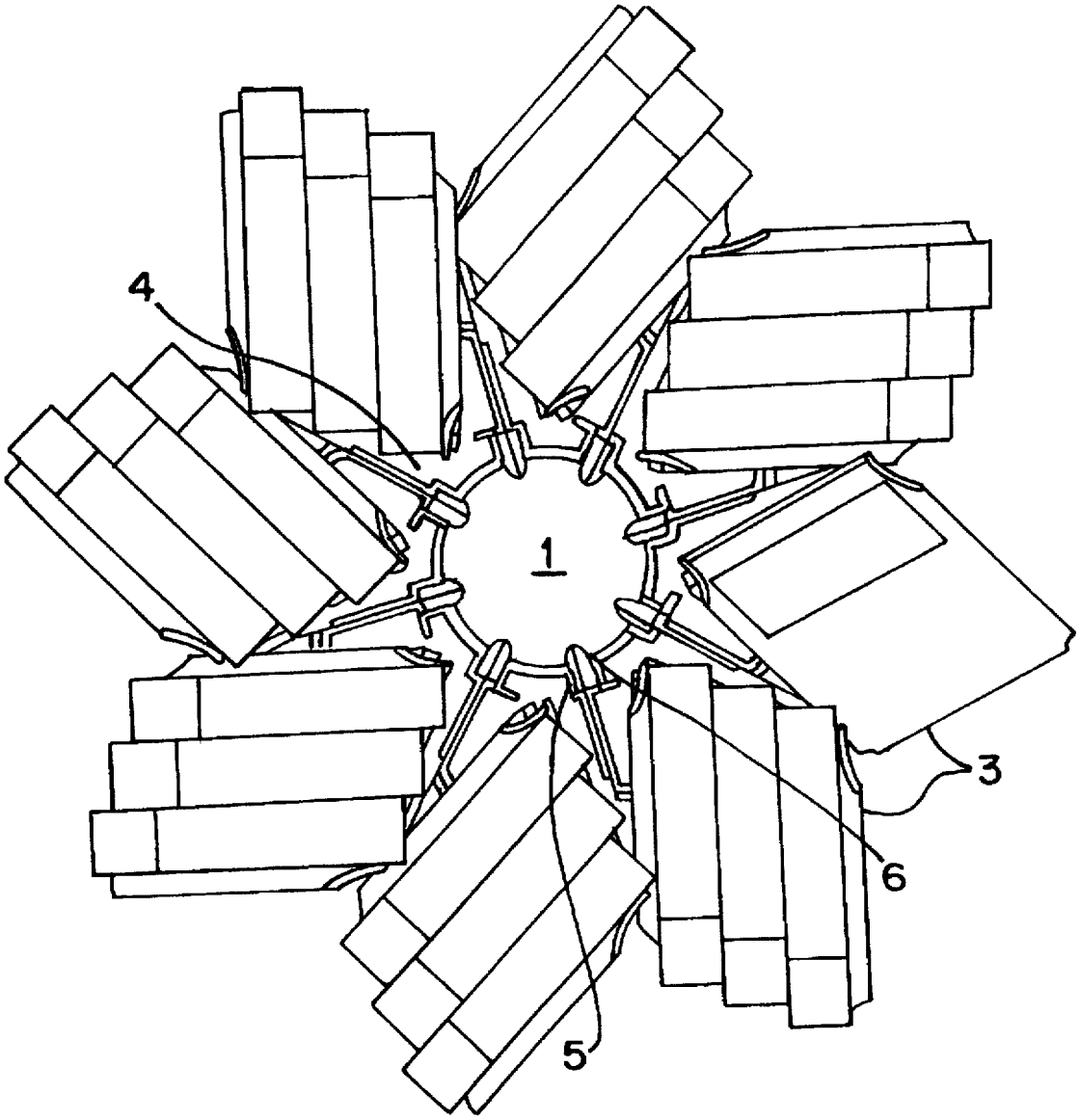
FIG. 4: a top plan view of a merchandise presentation system according to the invention.

FIG. 4 shows a top plan view of the merchandise presentation system in which merchandise carriers 3, occupied for the most part by books, are arranged all around support pole 1. The base outline of each merchandise carrier 3, configured in each case as a non-rectangular parallelogram, is clearly visible. As is evident from the partly visible book spines, the oblique position of push-in part 10 apparent from FIG. 2 causes merchandise carrier 3 to tilt slightly inward toward support pole 1. Once in place, the books are thus kept from accidentally falling out.

Figure 5:
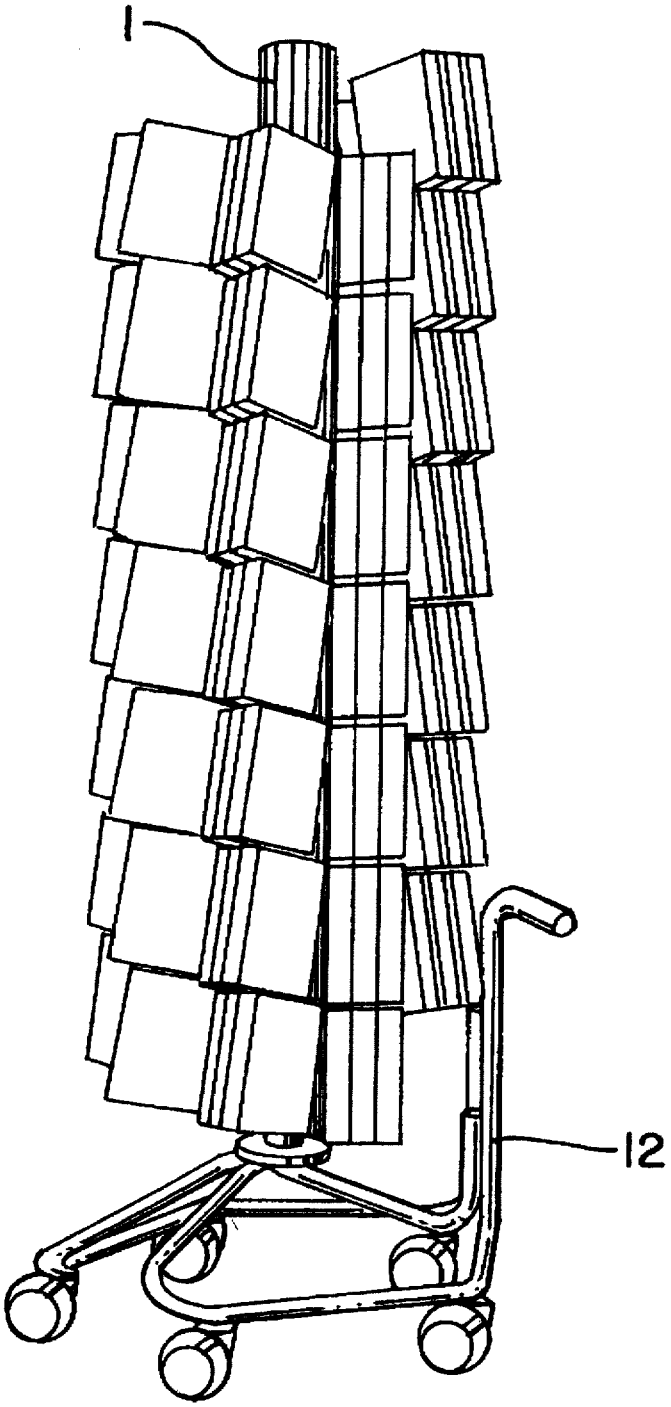
FIG. 5: a side view of a merchandise presentation system according to the invention on a movable rotating column.

In mounting means 4 shown in detail in FIG. 1 and FIG. 2, profiled extensions 5 and 6 are spaced apart vertically from one another in accordance with the pattern of openings 2 in FIG. 1. The consequence of the pattern of openings 2, and of the arrangement of profiled extensions 5 and 6 on the respective mounting means 4, is that the individual merchandise carriers 3 are to be mounted on support pole 1, next to one another and in a continuous sequence with a height offset to one another, in such a way that support pole 1, when finally completely occupied by filled merchandise carriers 3, has a helical structure as depicted schematically in FIG. 5. In the exemplary embodiment shown, support pole 1 is mounted in axially rotatable fashion on a frame 12 that is movable on rollers. Beginning at the group of books arranged lowest down on the right, the customer can, by means of a continuous counterclockwise rotation of the support mast, browse through all the groups of books contained in a particular merchandise carrier, the eye being quite automatically guided to the group of books arranged at the very top.

I claim:

1. A merchandise presentation system, comprising:

(a) a support pole being rotatably mounted in a stand and a plurality of merchandise carriers;

(b) at least one mounting means associated with each carrier for establishing cooperative engagement between the support pole and each merchandise carrier;

(c) the mounting means being configured so that the merchandise carriers can be individually mounted on the support pole from a lateral direction substantially perpendicular to the longitudinal axis of the support pole;

(d) the support pole having a plurality of openings adapted to receive and engage the mounting means;

(e) said openings including undercuts and the mounting means each comprising at least one profiled extension adapted to insertion into the openings;

(f) said profiled extensions also including undercuts that cooperate with the opening undercuts so that once an extension is inserted into an opening it can displaced substantially downward and thereby positively fastened to the support pole; and (g) at least some of the mounting means comprising two profiled extensions and at least some openings being adapted to receive and engage such mounting means.

2. The merchandise presentation system according to claim 1, wherein the mounting means comprising two profiled extensions, one profiled extension has an undercut left-hand vertical flank, and the other profiled extension has an undercut right-hand vertical flank.

3. The merchandise presentation system according to claim 2, wherein the profiled extensions in mounting means comprising two profiled extensions are spaced apart horizontally from each other.

4. The merchandise presentation system according to claim 3, wherein the profiled extensions on the mounting means are vertically offset with respect to each other.

5. The merchandise presentation system according to claim 4, wherein the openings are configured as substantially vertically arranged grooves, and the profiled extensions have at most half the length of the openings.

6. The merchandise presentation system according to claim 1, wherein the merchandise carriers and mounting means each have a side facing and adjacently arranged merchandise carrier, a projection and a matching recess respectively, the projection of the one merchandise carrier engaging, when fastened to the support pole positively into the recess of another merchandise carrier.

7. The merchandise presentation system according to claim 6, wherein the projection and recess are each laterally undercut so as to fit one another, and in this manner form an insertion profile.

8. The merchandise presentation system according to claim 7, wherein the mounting means are configured as uniform coupling elements that are removable from the respective merchandise carrier.

9. The merchandise presentation system according to claim 8, wherein the mounting means are adapted to provide releasable engagement between the merchandise carriers and support pole.

10. The merchandise presentation system according to claim 9, further comprising a retaining means for establishing snap-engagement between the mounting means and openings.

11. The merchandise presentation system according to claim 10, wherein the mounting means further comprise support rails for stabilizing the merchandise carriers.

12. The merchandise presentation system according to claim 11, wherein the merchandise carriers have a base outline configured substantially as a non-rectangular parallelogram.

13. The merchandise presentation system according to claim 12, wherein the mounting means are configured so that the merchandise carriers when fastened to the support pole are tilted slightly backward and/or to the side.

14. The merchandise presentation system according to claim 13, wherein the mounting means and the merchandise carriers are at least partly plastic.

15. The merchandise presentation system according to claim 14, wherein the support pole is configured as a hollow tube which has perforations forming the openings.

16. The merchandise presentation system according to claim 15, wherein the support pole comprises a hollow plastic profile.

17. The merchandise presentation system according to claim 16, wherein the individual merchandise carrier can be mounted on the support pole next to one another and in a continuous series, offset in height from one another in such a way that the support pole once completely occupied by merchandise carriers acquires a helical appearance.

* * * * *